United States Patent [19]

Woloszczuk

[11] 4,109,254

[45] Aug. 22, 1978

[54] DIPOLE RADIATORS FOR FEEDING A PARABOLIC REFLECTOR

[75] Inventor: Edmund Wergiliusz Woloszczuk, Chelmsford, England

[73] Assignee: The Marconi Company Ltd., Chelmsford, England

[21] Appl. No.: 724,554

[22] Filed: Sep. 20, 1976

[30] Foreign Application Priority Data

Sep. 20, 1975 [GB] United Kingdom ..... 38682/75
Dec. 1, 1975 [GB] United Kingdom ..... 49345/75

[51] Int. Cl.[2] ..... H01Q 21/26

[52] U.S. Cl. ..... 343/797; 343/840; 343/822

[58] Field of Search ..... 343/789, 797, 798, 822, 343/821, 840, 860–865

[56] References Cited

U.S. PATENT DOCUMENTS

| | | | |
|---|---|---|---|
| 2,420,967 | 5/1947 | Moore | 343/798 |
| 3,618,105 | 11/1971 | Bruene et al. | 343/797 |
| 3,740,754 | 6/1973 | Epis | 343/789 |
| 3,803,617 | 4/1974 | Ajioka et al. | 343/797 |
| 3,983,562 | 9/1976 | Blanchard et al. | 343/840 |
| 4,005,433 | 1/1977 | Tsuda | 343/840 |
| 4,042,935 | 8/1977 | Ajioka et al. | 343/797 |

*Primary Examiner*—Alfred E. Smith
*Assistant Examiner*—David K. Moore
*Attorney, Agent, or Firm*—Diller, Brown, Ramik & Wight

[57] ABSTRACT

The invention is concerned with the provision of a dipole radiator for feeding a parabolic reflector and provides a half wave dipole arranged at the mouth of a shallow cavity. The cavity is preferably circular with a diameter approximately three times its depth. In an example of linearly polarised radiator a cylindrical cavity is provided having a diameter of 0.72λ and a height of 0.26λ and the half wave dipole element is positioned 0.26λ above the base of the cavity so that the dipole element extends beyond the cavity. In an example of circularly polarised radiator two crossed half wave dipole elements are provided, one of which is arranged to be inductive and the other of which is arranged to be capacitive. The cylindrical cavity has a diameter of 0.66λ and a height of 0.28λ and the crossed dipole elements are positioned 0.22λ above the base of the cavity so as to lie flush with the mouth of the cavity.

13 Claims, 7 Drawing Figures

DIPOLE RADIATORS FOR FEEDING A PARABOLIC REFLECTOR

Figure 1:
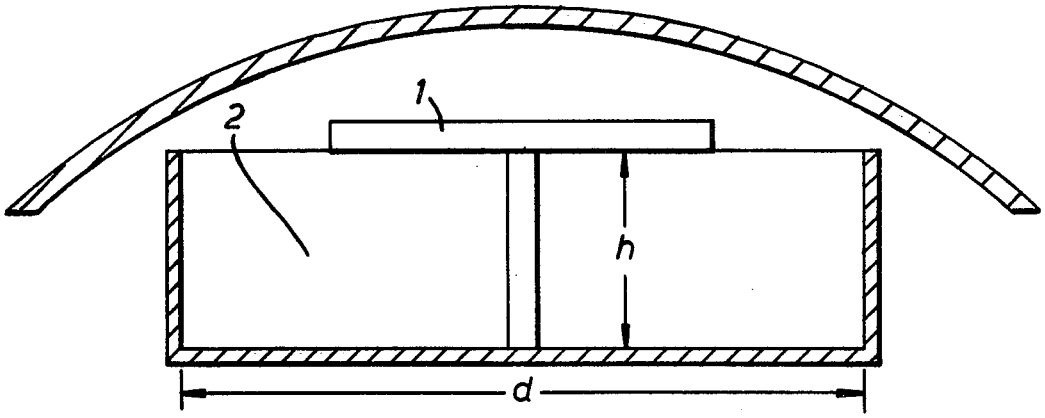

This invention relates to dipole radiators and in particular to such radiators for feeding parabolic reflectors.

The use of a half wave dipole with a reflector or splash plate is known to be a poor feed for a parabolic dish because of inequalities in the E and H plane beams.

The present invention seeks to provide an improved dipole radiator suitable for feeding a parabolic reflector and utilising a half wave dipole, in which the above problem is reduced.

According to this invention, a dipole radiator suitable for feeding a parabolic reflector comprises a half wave dipole arranged at the mouth of a shallow cavity.

Preferably said cavity is cylindrical.

Preferably the diameter of said cylindrical cavity is approximately three times its depth.

In one example of a linearly polarised radiator in accordance with the present invention the height of the half wave dipole element above the base of the cavity approximately equals the depth of said cavity so that the dipole element extends beyond said cavity. Preferably said cylindrical cavity has a diameter of 0.72λ and a height of 0.26λ and the half wave dipole element is positioned 0.26λ above the base of said cavity.

One or more annular chokes may be provided in said cavity in order to reduce the back radiation of the radiator.

In an example of a circularly polarised radiator in accordance with the present invention two crossed half wave dipole elements are provided, one of which is arranged to be inductive and the other of which is arranged to be capacitive.

Preferably the height of said crossed dipoles above the base of said cavity is such that said crossed dipole elements lie flush with the mouth of said cavity. Preferably said cylindrical cavity is a diameter of 0.66λ and a height of .28λ and said crossed dipole elements are positioned .1λ above the base of said cavity.

Preferably each of said two crossed half wave dipole elements is provided with its own feed point.

By providing separate feed points for the two crossed half wave dipole elements, the two elements may be fed from a power divider, such as a hybrid power divider, which may incorporate a load in order to absorb power reflected back from a parabolic dish to said dipole radiator when the latter is provided as a feed for said dish.

In addition, the present invention because of the two feeds, permits if required, the switching of circularity from left hand to right hand.

Preferably said two half wave dipole elements are fed by baluns formed of a solid metal rod having four longitudinally extending slots therein dividing the rod, for a portion of its length, into four parts, two of which are utilised to feed one of the crossed dipole elements and the remaining two of which are utilised to feed the two elements of the remaining crossed dipole element.

Typically said rod is a round metal rod and said portion of its length is approximately equal to λ/4 where λ is the wavelength corresponding to the mean frequency of operation of the radiator. Typically said rod is of 1.5 centimeters in diameter.

Preferably the feed for said baluns provided by the divided parts of said rod comprises for each dipole element a co-axial cable extending through one of the associated two parts with its outer conductor electrically connected to said last mentioned parts and its inner conductor connected to the other of said last mentioned two parts.

Preferably said cavity is surrounded by at least one annular ring.

The feeder arrangement for said dipole or dipoles may pass through the base of said cavity or may be provided on the side of the dipole or dipoles remote from the base of said cavity.

Figure 2:
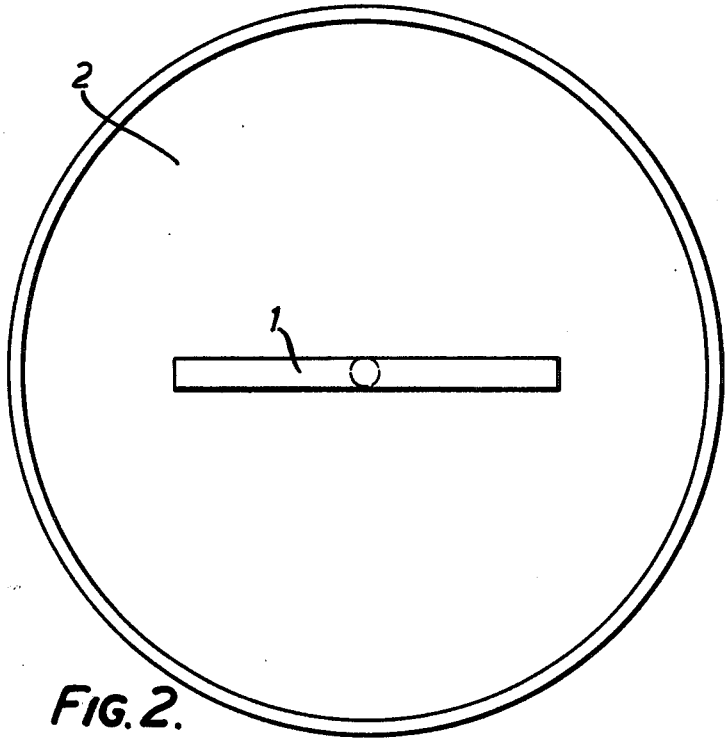
Figure 3:
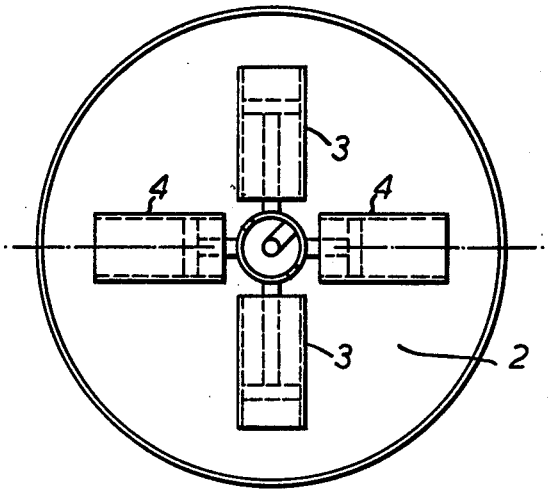
Figure 4:
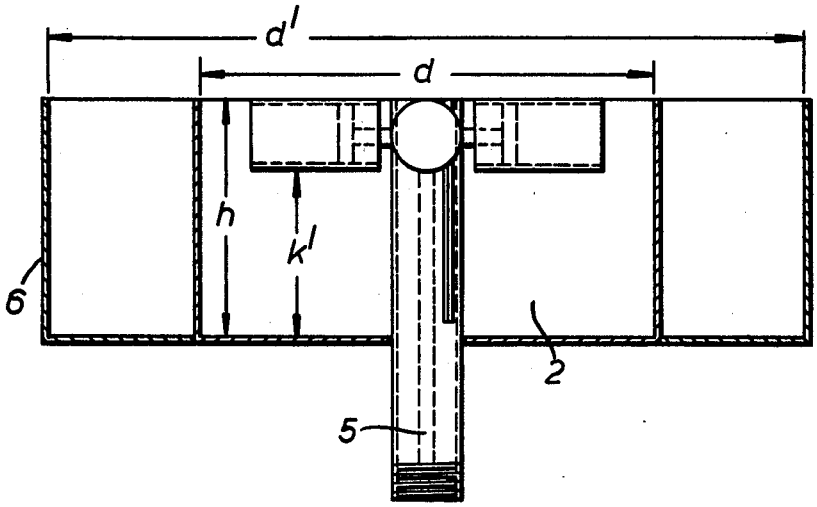
Figure 5:
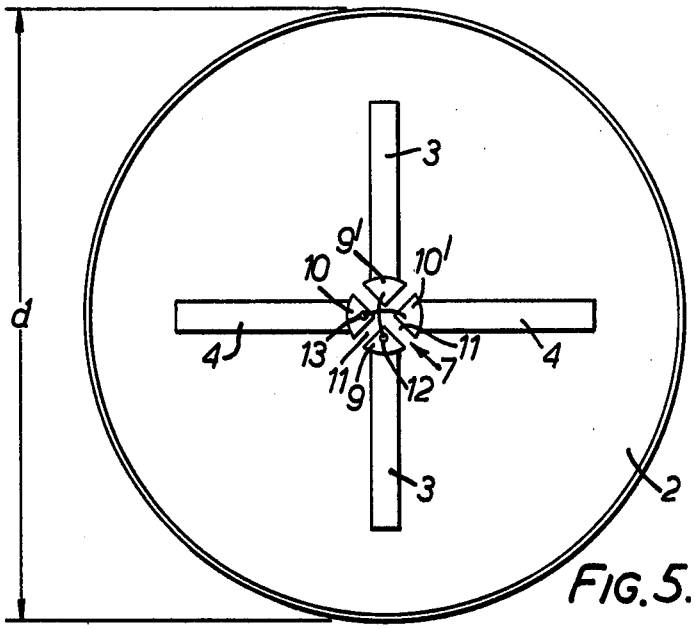
Figure 6:
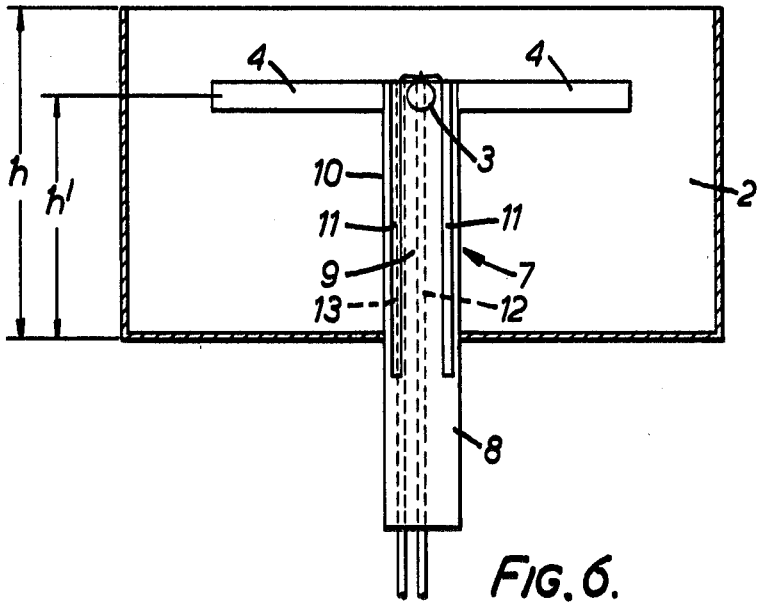
Figure 7:
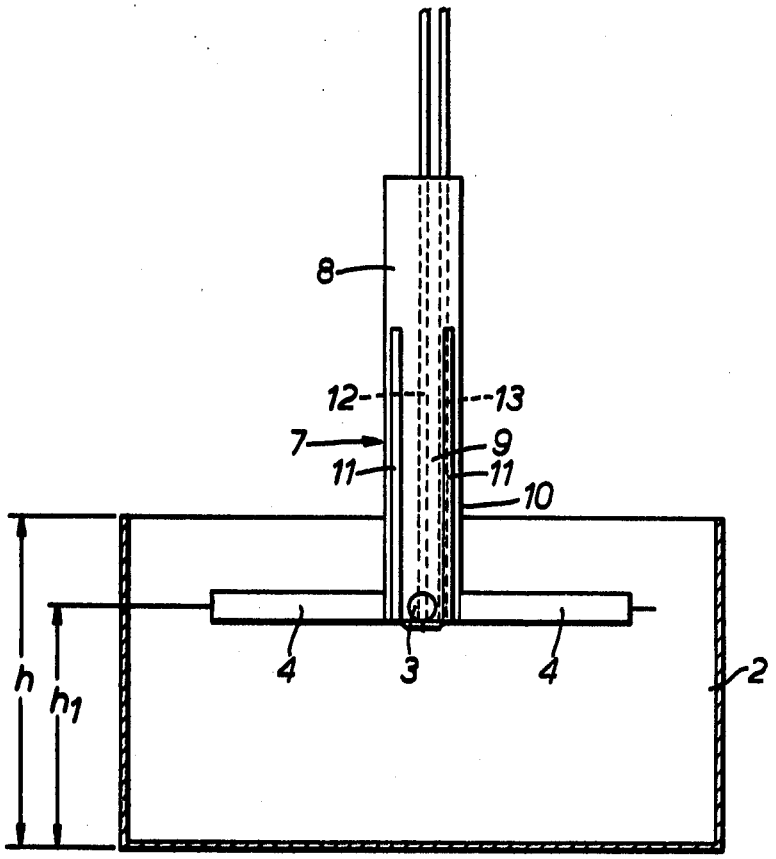

The invention is illustrated in and further described with reference to the accompanying drawings in which, FIG. 1 is a schematic section in side elevation of one linearly polarised radiator in accordance with the present invention, FIG. 2 is a plan view of the radiator of FIG. 1, FIG. 3 is a plan view of one circularly polarised radiator in accordance with the present invention, FIG. 4 is a section in side elevation along the line A-A of FIG. 3, FIG. 5 is a plan view, FIG. 6 is a side elevation of one dipole radiator in accordance with the present invention and FIG. 7 is a side elevation of a modification of the dipole radiators of FIG. 6.

In the Figures, like references are used for like parts.

Referring to FIGS. 1 and 2, a balanced half wave dipole element 1 is mounted at the mouth of a cavity 2. The cavity has an internal diameter *d* equal to 0.72λ and a height *h* equal to 0.26λ with the dipole element 1 mounted at a height again 0.26λ above the base of the cavity so that the dipole element 1 extends beyond the cavity. As will be seen, the dipole element 1 is mounted in the center of the cavity.

With the radiator illustrated, utilising a slot fed dipole it was found that the input impedance was approximately 50 ohms whilst the half power beam (3dB down) was approximately 78° and the aperture taper at 10dB down was approximately 158° (79° half beam).

If desired one or more annular chokes (not shown) may be introduced into the cavity in order to reduce the back radiation of the radiator. The provision of one or more annular chokes will also have the effect of reducing the beam width for 3dB and 10dB down. The reduction in beam width will be greater as the size and number of annular chokes increase.

Referring to FIGS. 3 and 4, in which like references are used for like parts in FIGS. 1 and 2, in this case two crossed dipole elements 3 and 4, of which dipole element 4 is provided to be inductive and dipole element 3 capacitive, are again mounted at the mouth of a cavity 2.

The crossed dipole arrangement has a single co-axial feed 5 and is slot fed.

The cavity 2 is circular and of diameter d equal to 0.66λ. The height *h* of the cavity 2 is 0.28λ and the dipole elements are positioned at a height *h* of equal to 0.22λ above the base of the cavity 2. As will be seen in this case the dipole elements lie flush with the mouth of the cavity 2.

The cavity 2 is surrounded by an annular ring 6 which is of diameter *d'* equal to 0.88λ. Annular ring 6 is not shown in FIG. 3. The example illustrated in FIGS. 3 and 4 provide a half power beam (at 3dB down) of 72° and an aperture taper at 10dB down of 144° (72° half beam). The diameter *d* of the cavity 2 may be varied in order to vary the beam width of the radiator to suit different types of parabolic reflectors with which it may be used. The effect of the diameter *d* of the cavity 2 upon the beam width is however not great and normally the diameter $d'$ of the annular ring 6 would be varied and, if necessary, more than one annular ring provided.

The annular ring 6 serves to improve the performance of the radiator so far as the side lobes and back radiation are concerned and has the effect of narrowing the E and H beamwidth. It achieves this effect by returning back-radiation from the parabolic reflector with a phase change which tends to produce a self cancelling effect. With the example shown in FIG. 4, if the annular ring 6 were omitted the beam width at 3dB down would be approximately 84°. With the annular ring 6 provided as shown, the beam width is 68°.

Referring to FIG. 5, two crossed dipole elements 3 and 4 are mounted at the mouth of a cavity 2. Each dipole element is arranged to be fed by a balun arrangement 7 which consists of a round metal rod 8, of diameter 1.5 centimeters, which is divided into four parts 9, 9' and 10, 10' by longitudinally extending slits 11. The slits 11 extend for a length equal to $\lambda/4$ where $\lambda$ is the wavelength corresponding to the mean frequency of operation of the radiator. The parts 9 and 9' form a balun for the dipole elements 3, whilst the parts 10 and 10' form a balun for the dipole elements 4. The balun 9, 9' is fed by a co-axial cable 12 which extends through a hole running the length of rod 8 and through part 9. The outer conductor of co-axial cable 12 is electrically connected to the part 9, whilst the inner conductor is connected to part 9'.

A co-axial cable 13 is similarly provided to feed balun 10 and 10'.

As with the arrangement shown in FIGS. 3 and 4 the cavity 2 is circular and of diameter $d$ equal to $0.66\lambda$. The depth $h$ of the cavity 2 is $0.28\lambda$ and the dipole elements are positioned at a distance $h'$, measured to the mean plane of the dipole elements, equal to $0.1\lambda$ from the base of the cavity 2.

When positioned to feed a parabolic reflector, the co-axial cables 12 and 13 would be fed from a strip line hybrid power divider which incorporates a load for absorbing power reflected back from the parabolic dish to the radiator, in operation.

An annular ring such as that shown at 6 in FIG. 4 may also be provided in this present case.

The provision of separate feeds for the crossed half wave dipole elements may be utilised to permit the switching of circularity from left hand (LH) to right hand (RH), if desired.

Referring to FIG. 7 this arrangement is in fact identical to that of FIG. 6 except that instead of the balun feed arrangement 7 passing through the base of the cavity 2, the balun 7 is provided on the side of dipole elements 3, 4 remote from the base of the cavity 2.

I claim:

1. A dipole radiator which comprises, in combination:

a shallow cavity presenting a mouth;

two crossed half wave dipole radiators disposed near said mouth of the shallow cavity and each consisting of two elements; and means for feeding said dipole elements with r.f. energy, said means comprising a metal rod having four longitudinally extending slots therein dividing said rod, for a portion of its length, into four parts, two of said parts being connected to the respective two elements of one of said dipole radiators and the other two of said parts being connected to the respective two elements of the other of said dipole radiators.

2. A radiator as claimed in claim 1 and wherein said cavity is cylindrical.

3. A radiator as claimed in claim 2 and wherein said cylindrical cavity is a diameter of $0.66\lambda$ and a height of $0.28\lambda$ and said crossed dipole elements are positioned $0.21\lambda$ above the base of said cavity, where $\lambda$ is the wavelength corresponding to the mean frequency of said r.f. energy.

4. A radiator as claimed in claim 1 and wherein one or more annular chokes are provided in said cavity in order to reduce the back radiation of the radiator.

5. A radiator as claimed in claim 1 and wherein one of said two crossed half wave dipole radiator is arranged to be inductive and the other of which is arranged to capacitive.

6. A radiator as claimed in claim 1 and wherein the diameter of said cylindrical cavity is approximately three times its depth.

7. A radiator as claimed in claim 1 and wherein said rod is a round metal rod and said portion of its length is approximately equal to $\lambda/4$ where $\lambda$ is the wavelength corresponding to the mean frequency of operation of the radiator.

8. A radiator as claimed in claim 1 and wherein said rod is of 1.5 centimeters in diameter.

9. A radiator as claimed in claim 1 and wherein said cavity is surrounded by at least one annular ring.

10. A dipole radiator as defined in claim 1 wherein said means for feeding also includes a first co-axial cable extending through one part of said two of said parts and having an outer conductor connected thereto and an inner conductor connected to the other part of said two of said parts, and a second co-axial cable extending through one part of said other two of said parts and having an outer conductor connected thereto and an inner conductor connected to the other part of said other two.

11. A dipole radiator as defined in claim 1 wherein said means for feeding passes through the base of said cavity.

12. A dipole radiator as defined in claim 1 wherein said means for feeding extends through the mouth of said cavity.

13. A dipole radiator as defined in claim 1 and including a parabolic reflector, said cavity being centered within said reflector.

* * * * *